US005632675A

United States Patent [19]

Kanninen et al.

[11] Patent Number: 5,632,675

[45] Date of Patent: May 27, 1997

[54] MIXING SECTION FOR SUPPLY AIR AND RETURN AIR IN AN AIR-CONDITIONING APPARATUS

[75] Inventors: Seppo K. Kanninen, Espoo; Seppo J. Leskinen, Västerskog; Ingmar E. Rolin, Espoo, all of Finland

[73] Assignee: ABB Flakt Oy, Helsinki, Finland

[21] Appl. No.: 537,901

[22] PCT Filed: Apr. 22, 1994

[86] PCT No.: PCT/FI94/00153

§ 371 Date: Jan. 16, 1996

§ 102(e) Date: Jan. 16, 1996

[87] PCT Pub. No.: WO94/25805

PCT Pub. Date: Nov. 10, 1994

[30] Foreign Application Priority Data

Apr. 23, 1993 [FI] Finland ..... 931849

[51] Int. Cl.[6] ..... F24F 13/04

[52] U.S. Cl. ..... 454/264; 454/229; 454/236; 454/263

[58] Field of Search ..... 454/229, 236, 454/261, 263, 264, 265, 269

[56] References Cited

U.S. PATENT DOCUMENTS

| | | | |
|---|---|---|---|
| 2,400,617 | 5/1946 | Wheller . | |
| 2,987,982 | 6/1961 | Wilson | 454/265 |
| 3,212,424 | 10/1965 | Davis | 454/269 X |
| 3,387,649 | 6/1968 | Mullins et al. | 454/269 X |
| 3,610,522 | 10/1971 | Tutt | 454/264 X |
| 4,350,100 | 9/1982 | Stephenson | 454/264 X |
| 5,127,878 | 7/1992 | Meckler | 454/264 |
| 5,413,530 | 5/1995 | Montaz | 454/264 X |

FOREIGN PATENT DOCUMENTS

| | | | |
|---|---|---|---|
| 2 844 046 | 11/1981 | Denmark . | |
| 0 260 736 | 3/1988 | European Pat. Off. . | |
| 0 303 850 | 2/1989 | European Pat. Off. . | |
| 502181 | 2/1976 | U.S.S.R. | 454/261 |
| 688786 | 9/1979 | U.S.S.R. | 454/264 |

*Primary Examiner*—Harold Joyce
*Attorney, Agent, or Firm*—Fitch, Even, Tabin & Flannery

[57] ABSTRACT

Mixing section for outdoor air and return air in an air-conditioning apparatus, the mixing section being positioned between a supply duct supplying outdoor air into a room and a return duct removing exhaust air from the room for mixing outdoor air and return air. The supply and return ducts comprise adjusting devices for adjusting the air flows. To control the air flows at different mixing ratios and to make the mixing more efficient, guides are provided after the adjusting devices of both the supply device and the return device in a mixing space so as to divide the air flows passing through the adjusting devices into a plurality of separate interlapping air jets crossing each other.

13 Claims, 2 Drawing Sheets

MIXING SECTION FOR SUPPLY AIR AND RETURN AIR IN AN AIR-CONDITIONING APPARATUS

This invention relates to a mixing section for supply air and return air in an air-conditioning apparatus comprising a supply device supplying outdoor air into a room and comprising a supply duct between outdoor air and the room for an outdoor air flow, and means for adjusting the outdoor air flow;

an exhaust device passing exhaust air from the room and comprising an exhaust duct from the room for an exhaust air flow, and means for adjusting the exhaust air flow; and a return device for returning exhaust air into the room and comprising a return duct between the exhaust duct and the supply duct for a return air flow, and means for adjusting the exhaust air flow;

the supply device and the return device having a common mixing space for mixing the outdoor air and return air flows.

The need for air-conditioning in buildings depends on the number of people staying in the building at a specific time, the amount of impurities entering the air, the heat load, etc. The air-conditioning system, especially the flow of air, has to be designed according to the maximum load. As the heat load is very often the factor determining the design values, the air-conditioning system often has to be operated at an unnecessarily high power, especially in winter, if the power cannot be adjusted. This would require a very high amount of energy, especially thermal energy, as whatever the way cold outdoor air is introduced into the building, the air has to be heated.

To avoid unnecessary consumption of energy, different ways of adjusting the power of the air-conditioning apparatus have been developed. The most natural way is to decrease the supply and exhaust air flows of the air-conditioning system simultaneously when full power is not needed. This may take place e.g. by adjusting the rotation speed of the blowers, by varying the performance curves of the blowers by adjusting the blade angle, or by bringing the air entering the blower into a rotation movement by so-called leading-blade adjusters or simply by increasing the air resistance of the system by dampers.

However, reduction in the air flow causes problems in the distribution of air into rooms. The properties of conventional air distribution means, especially the throw length, change as the air flow is reduced so that the air flow emerging from the air distribution means will not reach everywhere in the room, and so the air will not change at all in some part of the room.

In addition to this common problem, all of the above-mentioned ways of adjustment have their own special problems.

So-called return air operation has been developed mainly to avoid air distribution problems. In the return air operation the flow of outdoor air into the building and the flow of so-called exhaust air from the building are reduced by dampers while passing a portion of the exhaust air flow after the exhaust blower to the suction side of the supply air blower, where it is mixed with outdoor air sucked by the blowers. The exhaust air portion to be passed back into the building is to be kept equal to the reduction of the outdoor and/or exhaust air flow caused by the dampers. The supply and exhaust air blowers and the air distribution means thereby operate all the time at the designed air flow rate.

In principle, the return air system seems to be simple, but once the return air damper is opened to admit exhaust air into the supply air blower, the fully separate exhaust and supply air systems become a single extremely complicated system difficult to control; experiences from apparatus implementations show that air flows in particular are impossible to control. The problems associated with return air operation are so complex that a comprehensive description of great complexity would be required to explain them thoroughly. Therefore it may suffice to refer to Finnish Patent Application 931 848 "An air-conditioning apparatus and a method of controlling its operation" having the same filing date as the present invention.

The manufacturers of air-conditioning apparatuses supply standardized mixing sections, the properties of which cannot be modified, and no performance data are usually given for the sections as a whole. Performance data are usually given for separate dampers to be installed in ducts, whereas the validity of the data when the dampers are installed in the mixing section has not been assured in any way, and no limit values have been given for the properties of adjustable systems. Even a superficial examination of such sections shows that the air flow of the system will increase considerably during return air operation. The zero point of the system pressure, i.e. the point, at which the pressure is equal to outdoor air pressure, will be positioned somewhere between the blower and the heating element, i.e. the outdoor and return air flows are completely uncontrollable, and so are the pressure ratios of the building.

It has happened frequently that blower motors have been switched off by themselves during return air operation due to the increased air flow and the resulting increase in the electric power. Several measurements have shown that the minimum flow of outdoor air cannot be achieved in spite of the limitations of the position of the damper. In certain cases, the pressure ratios within the building have been disturbed so badly during return air operation that the front doors have been difficult to open. As a result, many researchers and building officials, among others, have suggested that the return air operation should be abandoned. Problems associated with the mixing process itself, especially cases where the exhaust air is moist either due to moisture evaporated into the air within the building or due to the humidification of supply air, have further justified such demands. In practice, condensate and frost formation has occurred in the mixing sections; in the worst case, the mixing sections have frozen when cold outdoor air and moist return air have come into contact with each other. The poor controllability of the air flows has obviously further aggravated the situation. The mixing section, which operates flawlessly in laboratory tests, when "appropriate" air flows are mixed at "appropriate" speeds, may cause great difficulties when the poor controllability of air flows results in the mixing of "inappropriate" air flows at "inappropriate" speeds.

The poor operation of the mixing section also endangers the operation of air-conditioning apparatus sections positioned after the mixing section. Due to the uneven speed and/or temperature distribution, the heating element will not reach its designed performance values or its resistance increases. It has even happened that the heating element has frozen due to the inefficient operation of the mixing section. The resistance of the filter section increases and its service life decreases, droplets are entrained in the air flow from the humidifying parts or cooling elements, causing moisture and hygiene problems, their resistance increases and the performance values deteriorate, etc.

Solutions have been suggested previously to increase the controllability of air flows and to achieve a desired mixing ratio between the return and outdoor air flows. In most air-conditioning apparatus, the return air operation can be controlled efficiently by the use of these solutions. In the industry in particular there are, however, rooms, such as printing plants and textile industries, where it is necessary that the ratio between the outdoor air and return air is continuously and accurately adjustable to allow the moisture and temperature conditions to be controlled accurately. Good mixing properties should be provided over the entire air flow area. As the return air has been humidified and its relative humidity may be high, it is not advisable to pass it into the heat exchanger of the heat recovery means, where part of the moisture would be condensed, while the supply air should be correspondingly humidified.

The object of the present invention is to provide a mixing section for an air-conditioning apparatus, which avoids the above-mentioned drawbacks and allows desired air flow rates to be maintained at all values of the mixing ratio and the outdoor air and return air to be mixed efficiently without any risk of freezing or condensing. The mixing section according to the invention also ensures even speed and temperature distribution after the mixing and allows accurate measurement of air flows at low costs.

This object is achieved by a mixing section according to the invention for an air-conditioning apparatus, which is characterized in that a guide means is provided in the mixing space at least after the adjusting means of the supply device or the adjusting means of the return device, respectively, the guide means dividing the air flow passing through the adjusting means into several separate air jets that cross and interlap with the air flow passing through the other adjusting means.

An essential feature of the invention is that both of the air flows to be mixed are guided so as to cause them to divide into several interlapping air jets that cross each other within the mixing area. In this way the induction and mixing between the return and outdoor air jets will be optimized. Guiding means dividing the air flows may be adjacent blades in blade dampers or other guiding plates which can be displaced for selecting the area of the discharge openings formed between the plates such that the air flow rates of the system will fall within a desired operating range even during return air operation. By suitably shaping the plates, the air flow can be measured from them with a high accuracy.

The advantages of the mixing section according to the invention can thus be summarized as follows:

improvement in the mixing properties is achieved by simple inexpensive additional parts, which can be installed in a standard air-conditioning apparatus;

the parts are easy to adjust, and so balancing the operation of the apparatus can be combined with improved mixing properties;

the parts are easy to shape such that the measurement and adjustment of the air flow can be performed by the same parts; and the assembly operates in a way such that measurable values are obtained even at small air flows.

In the following the invention will be described in greater detail with reference to the attached drawings, in which FIG. 1 is a schematic view of a preferred embodiment of a mixing section in an air-conditioning apparatus according to the invention;

Figure 1:
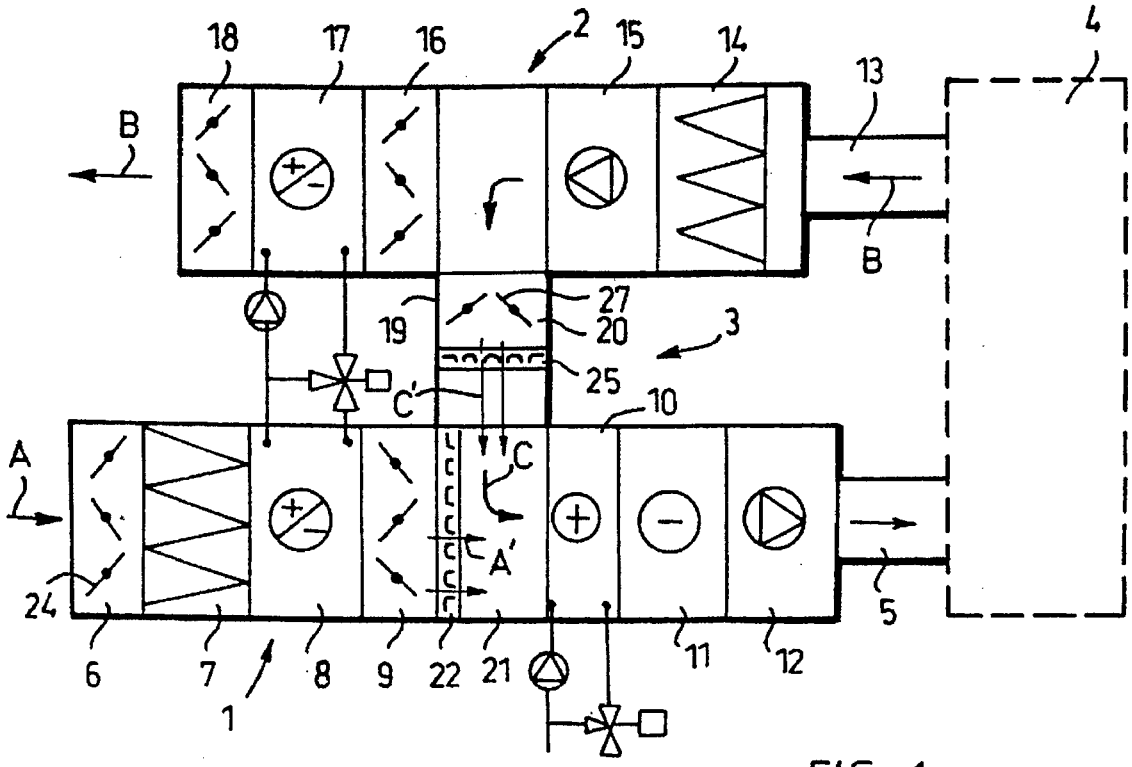

The air-conditioning apparatus shown in FIG. 1 of the drawings comprises a supply device 1, an exhaust device 2, and a return device 3.

The supply device 1 comprises a supply air duct 5 from outdoor air to a room 4. A damper 6, a filter 7, a heat recovery means 8, a damper 9, heating and cooling elements 10, 11, and a blower 12 are installed inside the duct 5. The blower creates an outdoor air flow A in the duct.

The exhaust device 2 comprises an exhaust air duct 13 from the room to outdoor air. A filter 14, a blower 15, dampers 16, a heat recovery means 17 and a damper 18 are installed inside the duct. The blower creates an exhaust air flow B in the duct.

The return device 3 comprises a return air duct 19, within which a damper 20 is installed. A return air flow C consisting of exhaust air passes through the duct.

Figure 2:
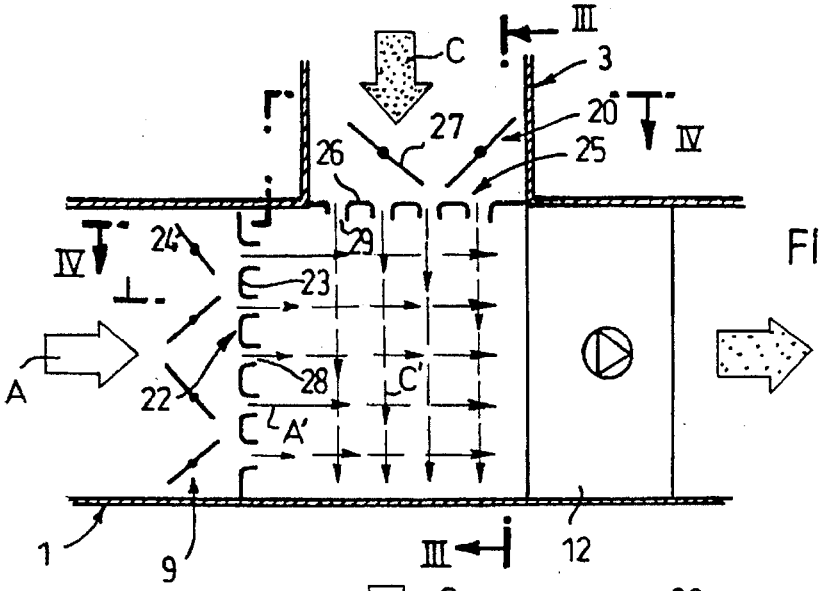
FIG. 2 is a schematic enlarged view of a mixing section, the guiding means being shown for the sake of clarity in a position turned through 90° from their proper position.
Figure 3:
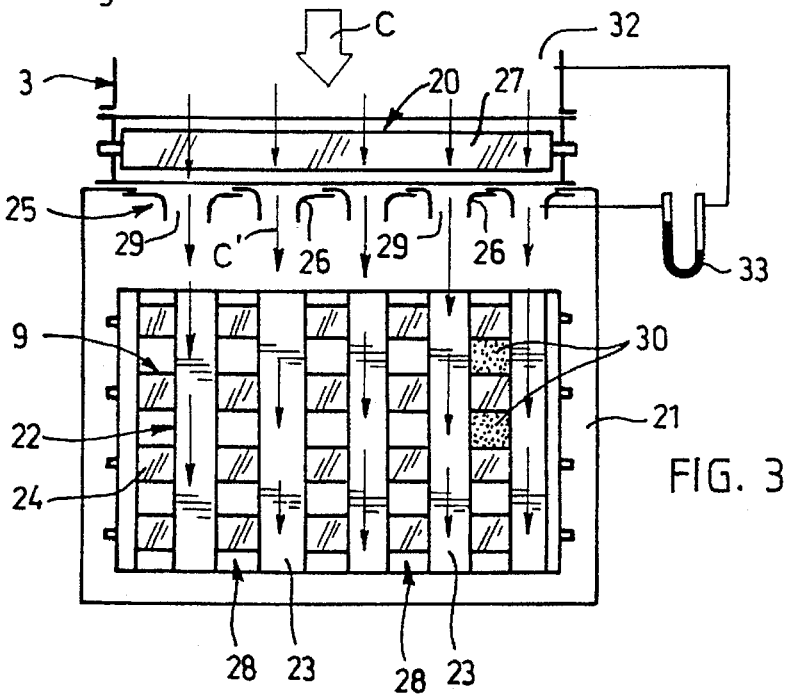
FIGS. 3 and 4 are more detailed sectional views of the mixing section along the line III—III and line IV—IV, respectively, shown in FIG. 2.
Figure 4:
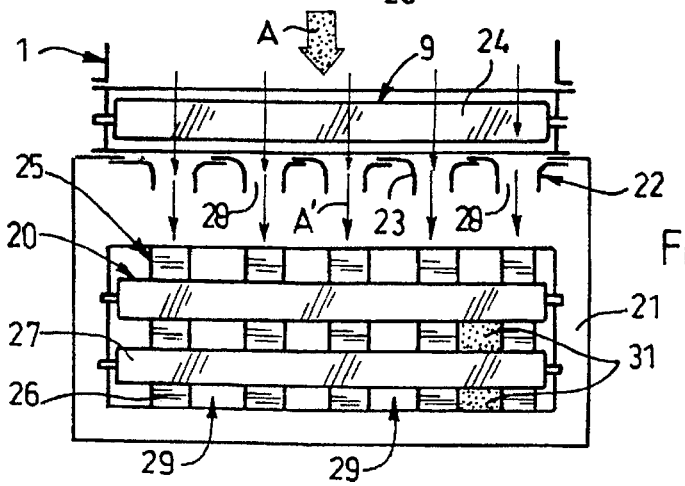

The outdoor air flow A and the return air flow C are mixed in a mixing box 21 of the apparatus, shown on a larger scale in FIGS. 2 to 4. A guide means 22 is provided after the outdoor air damper 9 in the direction of the air flow. The guide means 22 comprises a plurality of adjacent guide plates 23 positioned at an angle of 90° with respect to the longitudinal direction of the blades 24 of the outdoor air damper 9 and defining together with the blades 24 a plurality of flow openings 30. Similarly, a guide means 25 is provided after the return air damper 20 in the direction of the air flow. The guide means 25 comprises a plurality of adjacent guide plates 26 positioned at an angle of 90° with respect to the longitudinal direction of blades 27 of the return air damper 20 and defining together with the blades 27 a plurality of flow openings 31. A plurality of slits 28 remain between the guide plates 23 for the passage of air. The slits between the guide plates 26 are indicated with the reference numeral 29. The guide plates of the guide means 22 and 25 are positioned in a displaced relation with respect to each other so that air jets A' and C' emerging from the openings 30 and 31 of the slits 28, 29 interlap upon flowing into the mixing box 21.

The invention allows the contact surface between the outdoor and return air flows, where the mixing takes place, to be many times greater than in conventional mixing sections, which, of course, decisively improves the mixing result. Moreover, the crossing air jets will reach everywhere in the mixing box; the return air jets C', for instance, reach down to the bottom of the box. Temperature layers occurring to the bottom of the box. Temperature layers occurring frequently in conventional mixing sections cannot be formed, the risk of condensing and freezing is decreased decisively, and air speed and temperature are even over the entire face area.

The behaviour of air in the mixing section will now be described more closely. In the case shown in FIG. 4, the guide plates 23 divide the outdoor air flow A into five subjets A' having, with the return air flow C, nine contact surfaces extending over the entire height of the mixing box in place of a single contact surface of a conventional mixing section. For this reason alone, in principle, the outdoor air will mix with the return air nine times more efficiently than in a conventional mixing section. The situation is further improved as the air flow of each subjet C' is only one fifth of the total outdoor air flow. As is well-known from the general theory of air jets, the throw length of an air jet, i.e. the distance over which the speed of the jet drops to a specific limit value, is directly proportional to the air flow. Reduction of the air flow into one fifth in an individual jet helps to speed up the achievement of even air speed and temperature.

However, there are still other advantages offered by the mixing section according to the invention. To explain these advantages, the speed distribution of air in the longitudinal direction of individual slits 28 will now be discussed. As appears from FIG. 3, the blades 24 of the damper 9 are perpendicular to the vertical slits 28. When the damper 9 is open, the sides of the blade 24 extend in the direction of the air flow, and so they will not affect the flow, and the speed in the longitudinal direction of the slit 28 is even. This is illustrated by the straight line D in FIG. 5, where the horizontal axis represents the distance from the edge of the slit 28 and the vertical axis represents the air speed.

Figure 5:
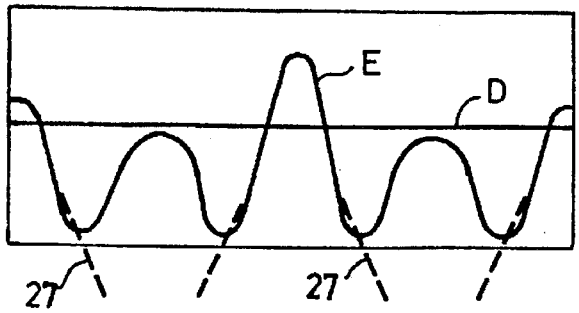
FIG. 5 illustrates the speed distribution of the outdoor air flow at the guiding means.

When the blades 24 of the damper 9 are turned to adjust the outdoor air flow, they cover the slit 28 partly and actually divide it into five smaller openings 30, two of which are shown as dotted areas in FIG. 3. The speed distribution is shown by the curve E in FIG. 5. The subjet A' from the slit 28 is thus further divided into five subjets, the speed of which is substantially equal to or greater than that of the total air flow, irrespective of the reduced air flow. When the air flow is decreased, the speed of the subjets increases and the jets become narrower and sharper. In FIG. 5, the broken lines indicate the positions of the blades 24, which explain why the maximum speeds of adjacent subjets are different.

The mixing section according to the invention thus creates 5×5=25 separate outdoor air jets, the entire perimeter of each jet acting as a mixing surface. The speed of the jets increases as the outdoor air flow is decreased, so that the mixing properties remain substantially constant. A major improvement is that the corresponding return air jets C' have to pass six separate outdoor air jets in place of one planar jet, which means that the air speed and pressure vary forcefully along their flow path. This increases considerably the turbulence and thus the mixing effect. The effect is even better than that obtained by flow barriers called turbulence plates used to facilitate the mixing of air.

As appears from the above, the mixing properties of the mixing section according to the invention are superior to those of mixing sections known from the prior art. Due to the excellent properties, mixing properties meeting the requirements of most practical applications can be obtained even though the outdoor air guide plates 23 are omitted. Instead, the outdoor air damper 9 is turned through 90° so that the blades 24 are in a vertical position, and the damper 9 is installed in such a manner that the air jets A' from between the blades 24 and the return air jets C' from between the slits 29 will interlap. Thus the outdoor air flow will not be exposed to an extra flow resistance caused by the guide plates 23, which reduces the power consumption and increases the controllability of the pressure ratios and air flows in the air-conditioning apparatus, which will be described below.

The principle according to the invention can be applied even if all of the guide plates 23, 26 are omitted and, instead, both the return air damper 20 and the outdoor air damper 9 are turned through 90° from the normal position, and installed such that the air jets from between the blades 24, 27 will interlap. The mixing properties will deteriorate considerably, although they are still much better than those of conventional mixing sections. This solution does not either offer the possibility of setting, adjusting and measuring the air flows, which will be described below.

The adjustable guide plates 26 allow the resistance of the flow path of the return air to be adjusted so that e.g. when the return air damper 20 is fully open, the total air flow of the air-conditioning apparatus is equal to that created when the outdoor and exhaust air dampers 9 and 16 are fully open by giving the slit 29 a predetermined width and area. In this way the air flows will be appropriate at least at two operating points of the apparatus.

This, however, is not enough when mixing is required at all air flow ratios. Appropriate supply and exhaust air flows can be obtained by measuring the air flow from the blower parts 12, 15, for which purpose known devices are commercially available, and by adjusting the exhaust and outdoor air dampers 9, 16 on the basis of the measuring result. On the contrary, the commercially available devices do not allow the return air flow to be measured and adjusted, and so the outdoor and return air mixing ratio remains uncontrollable.

If the guide plates 26 are shaped as shown in FIG. 3, i.e. in the form of a nozzle, they will create an even and stable air jet, from which the air speed and thus the air flow can be measured reliably e.g. by measuring differential pressure between the nozzle 29 and a space 32 preceding the damper 20 by a simple differential pressure gauge 33. This also allows the return air flow to be controlled and the mixing ratio to be adjusted accurately. By positioning the measuring points in the middle of the openings 29, the measuring value will be positioned at the peak of the curve E in FIG. 5, which ensures a high measuring accuracy even with small air flows. The return air flow is adjusted on the basis of the measuring value of the differential pressure gauge. Calibration curves, of course, have to be measured for the different adjustment positions of the control plates 26, but this can be done as a single operation in a laboratory test.

The drawings and the description related to them are only intended to illustrate the idea of the invention. In its details, the mixing section according to the invention may vary within the scope of the claims.

We claim:

1. A mixing section for supply air and return air in an air-conditioning apparatus comprising:

a supply device supplying outdoor air into a room and comprising a supply duct between outdoor air and the room for an outdoor air flow, and means for adjusting the outdoor air flow;

an exhaust device passing exhaust air from the room and comprising an exhaust duct from the room for an exhaust air flow, and means for adjusting the exhaust air flow;

a return device for returning exhaust air as return air flow into the room and comprising a return duct between the exhaust duct and the supply duct for the return air flow, and means for adjusting the return air flow, the supply device and the return device having a common mixing space for mixing the outdoor air and return air flows; and a guide means provided at the side of the mixing space which is at least after one of the adjusting means of the supply device and the adjusting means of the return device, and which forms air flow paths after the one adjusting means for guiding the air flow passing through the one adjusting means into the mixing space through said flow paths in several separate air jets which cross and interlap with the air flow passing through the other adjusting means and into the mixing space.

2. A mixing section according to claim 1, wherein the at least one of the means for adjusting outdoor air flow and the means for adjusting return air flow cooperates with the guide means to divide the air flow into several separate air jets for flow into the mixing space.

3. A mixing section according to claim 1, wherein the at least one of the means for adjusting outdoor air flow and the means for adjusting return air flow is a damper provided with adjustable blades, and the guide means comprises a plurality of adjacent guide plates perpendicular to the longitudinal direction of the blades of the damper and defining therebetween air flow slits.

4. A mixing section according to claim 3, wherein the guide plates are adjustable with respect to each other for adjusting the width of the air flow slits.

5. A mixing section according to claim 3 wherein the guide plates are shaped so that the slits between the guide plates form slit nozzles.

6. A mixing section according to claim 3 wherein the blades of the damper and the guide plates of the guide means are positioned so that the blades divide the air flow slits between the guide plates into several flow openings.

7. A mixing section according to claim 1 wherein the guide means is provided both after the adjusting means of the supply device and after the adjusting means of the return device to form air flow paths after both the adjusting means of the supply and return devices to divide the outdoor air flow and the return air flow in the mixing space into interlapping air jets flowing substantially perpendicular to each other.

8. A mixing section according to claim 7, wherein the guide means includes guide plates for the supply device which define air flow slits and guide plates for the return device which define air flow slits which are displaced with respect to the supply device air flow slits so that air from the supply device air flow slits is interposed between air from the return device air flow slits.

9. A mixing section according to claim 5 wherein a gauge is positioned in one of the slits between the guide plates for measuring and/or adjusting the air flow.

10. A mixing section according to claim 9 wherein the return air flow is adjusted on the basis of the air flow measured by the gauge.

11. A mixing section according to claim 4 wherein the guide plates are shaped so that the slits between the guide plates form slit nozzles.

12. A mixing section according to claim 4 wherein the blades of the damper and the guide plates of the guide means are positioned so that the blades divide the air flow slits between the guide plates into several flow openings.

13. A mixing section according to claim 9, wherein the gauge comprises a differential pressure gauge for measuring differential pressure between the one slit and a space preceding the air flow adjusting means in the direction of the flow.

* * * * *